US007893847B2

(12) United States Patent
Shanbhag et al.

(10) Patent No.: US 7,893,847 B2
(45) Date of Patent: Feb. 22, 2011

(54) REAL TIME DETECTION OF PARKING SPACE AVAILABILITY

(75) Inventors: Amit Umesh Shanbhag, San Francisco, CA (US); Glen Ames, Mountain View, CA (US); Philip Aaronson, Mountain View, CA (US)

(73) Assignee: Yahoo! Inc., Sunnyvale, CA (US)

( * ) Notice: Subject to any disclaimer, the term of this patent is extended or adjusted under 35 U.S.C. 154(b) by 363 days.

(21) Appl. No.: 12/169,849

(22) Filed: Jul. 9, 2008

(65) Prior Publication Data

US 2010/0007525 A1 Jan. 14, 2010

(51) Int. Cl.
*G08B 1/00* (2006.01)

(52) U.S. Cl. ..... 340/932.2; 340/933; 340/937; 340/942; 340/435; 340/436; 348/149; 382/104

(58) Field of Classification Search ..... 340/932.2, 340/933, 937, 905, 942, 435, 436; 348/148, 348/149; 382/104
See application file for complete search history.

(56) References Cited

U.S. PATENT DOCUMENTS

| | | | | |
|---|---|---|---|---|
| 6,340,935 | B1 * | 1/2002 | Hall | 340/932.2 |
| 6,501,391 | B1 | 12/2002 | Racunas | |
| 6,529,142 | B2 | 3/2003 | Yeh et al. | |
| 7,026,954 | B2 * | 4/2006 | Slemmer et al. | 340/932.2 |
| 7,123,166 | B1 * | 10/2006 | Haynes et al. | 340/932.2 |
| RE40,013 | E | 1/2008 | Quinn | |
| 7,383,248 | B2 | 6/2008 | Chen | |
| 7,492,283 | B1 * | 2/2009 | Racunas, Jr. | 340/932.2 |
| 7,516,010 | B1 * | 4/2009 | Kaplan et al. | 701/201 |
| 7,538,690 | B1 * | 5/2009 | Kaplan et al. | 340/932.2 |
| 2002/0008614 | A1 | 1/2002 | Yeh et al. | |
| 2003/0169183 | A1 | 9/2003 | Korepanov et al. | |

OTHER PUBLICATIONS

U.S. Appl. No. 12/029,243, filed Feb. 11, 2008, 36 pages.
MeshNetics, ZigBee Applications, Parking Lot Gets Smart with ZigBee, retreived Mar. 21, 2010, (2006-2008), 6 pages.
Vega, Cecilia M., "Port tries to get more out of parking meters: Pilot program uses sensors to monitor demand for spaces", San Francisco Chronicle, (Dec. 27, 2005), 2 pages.
True, Nicholas "Parking Space Detection", Department of Computer Science, University of California, San Diego, (1998), 2 pages.
Nortech Detection—Parking Detection, Nortech Detection Pty. Ltd, (Mar. 20, 2010), 3 pages.

* cited by examiner

*Primary Examiner*—Davetta W Goins
(74) *Attorney, Agent, or Firm*—Fiala & Weaver P.L.L.C.

(57) ABSTRACT

Methods, systems, and apparatuses for determining parking availability are described. A sensor system is configured to monitor a plurality of parking spaces. The sensor system includes at least one sensor element that generates a sensor data output signal. A parking availability determiner receives the sensor data output signal and generates parking availability information. The parking availability determiner is configured to determine from the received sensor data output signal at least one parking space of the plurality of parking spaces that is occupied, and to include an indication in the parking availability information that the determined at least one parking space is occupied. If one or more further parking space are included in the plurality of parking spaces other than the determined at least one parking space, an indication is included in the parking availability information that the further parking spaces are available for parking.

16 Claims, 11 Drawing Sheets

REAL TIME DETECTION OF PARKING SPACE AVAILABILITY

BACKGROUND OF THE INVENTION

1. Field of the Invention

The present invention relates to the determining of parking availability.

2. Background Art

To efficiently drive from one geographic location to another, it generally is beneficial to have driving directions. A number of interactive Internet-based mapping portals are available to generate such driving directions, including Yahoo!® Maps, MapQuest, and Google™ Maps. To use a mapping portal to generate driving directions, a user typically enters a start location (e.g., in the form of a mailing address) and a finish location. The mapping portal processes the start location and finish location information, and generates a map with generated driving directions overlaid thereupon.

Frequently, an individual that plans on driving from a start location to a finish location will need a parking space at the finish location. The locating of parking in towns/cities having scarce parking resources and/or strict parking regulations is a non-trivial task. Unfamiliarity by the individual with the destination locality can further compound this problem. Thus, the locating of parking in many localities can be time consuming. Furthermore, once a parking resource is determined, typically there is no way of determining whether any parking spaces will be available there, or where the parking spaces are located, when the individual arrives at the parking resource in the user's vehicle. This can lead to quite a bit of time wasted by the individual driving around trying to find an open parking space.

Thus, planning a point-to-point trip that accounts for a need to find parking can be quite a complex problem. What is desired are ways of efficiently and easily planning a point-to-point trip that accounts for the need for available parking at the end destination.

BRIEF SUMMARY OF THE INVENTION

Methods, systems, and apparatuses for determining parking availability are described. According to one method for determining availability of vehicle parking, a plurality of parking spaces is monitored. At least one parking space of the plurality of parking spaces that is occupied is determined from the monitoring. Parking availability information is generated that includes an indication that the determined at least one parking space is occupied. Further parking spaces included in the plurality of parking spaces other than the determined at least one parking space are indicated as available.

Furthermore, the parking availability information may be transmitted to a device. A user may view the parking availability information on the device when selecting a parking lot to park in, and/or when driving around in the parking lot to find a parking space.

In an example system implementation, a parking availability determining system includes a sensor system and a parking availability determiner. The sensor system is configured to monitor a plurality of parking spaces. The sensor system includes at least one sensor element that generates a sensor data output signal. The parking availability determiner receives the sensor data output signal and generates parking availability information. The parking availability determiner is configured to determine from the received sensor data output signal at least one parking space of the plurality of parking spaces that is occupied, and to include an indication in the parking availability information that the determined at least one parking space is occupied. If one or more further parking space are included in the plurality of parking spaces other than the determined at least one parking space, an indication is included in the parking availability information that the further parking spaces are available for parking.

Furthermore, the system may include a communication interface configured to transmit the generated parking availability information to a requesting device.

In another method for determining availability of vehicle parking, each parking space of a plurality of parking spaces is marked with a corresponding symbol. An image is captured of the plurality of parking spaces. At least one parking space having the symbol at least partially obstructed in the image is determined. An indication that the determined at least one parking space is occupied is stored. If one or more further parking spaces are included in the plurality of parking spaces other than the determined at least one parking space, an indication that the further parking spaces are available is stored.

In another implementation, an image capturing device is configured to capture an image of a plurality of parking spaces. The parking spaces are marked with symbols. A parking availability determiner receives the captured image. The parking availability determiner determines at least one parking space that has the symbol at least partially obstructed in the image. The parking availability determiner provides an indication that the determined at least one parking space is occupied.

These and other objects, advantages and features will become readily apparent in view of the following detailed description of the invention. Note that the Summary and Abstract sections may set forth one or more, but not all exemplary embodiments of the present invention as contemplated by the inventor(s).

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1:
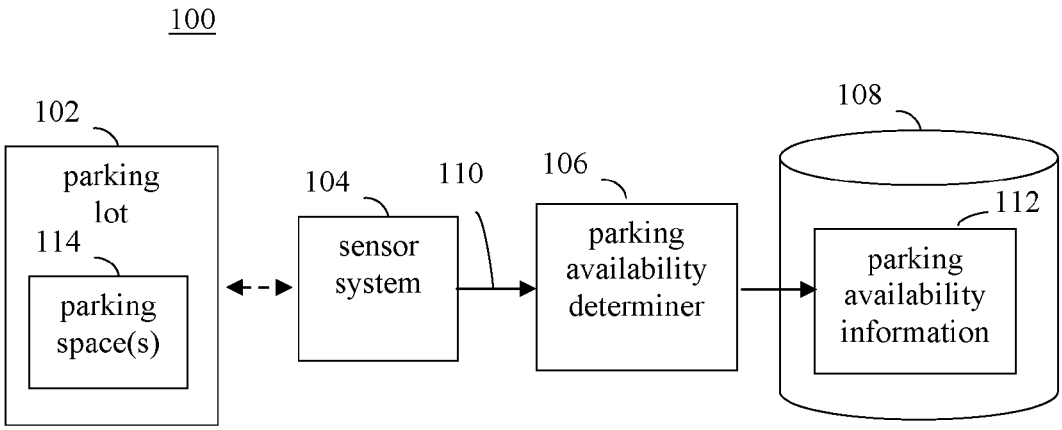
FIG. 1 shows a block diagram of a system configured to determine availability of vehicle parking, according to an example embodiment of the present invention.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Example Parking Availability Determiner Embodiments

Embodiments of the present invention relate to the determining of parking availability. In an embodiment, a parking availability determination may be made in "real time." The ability to determine availability of parking spaces close to a destination in real time can be very useful for a user. Parking can vary based on availability, price, and proximity to a destination. Price and proximity tend to remain fairly stable for parking spaces. Availability, however, changes with time. This is similar to driving, where driving directions from one point to another point tend to remain fairly stable, while traffic conditions change and tend to be somewhat unpredictable. Real time traffic information overlay on driving directions allows users to make better decisions about which route to choose to a destination. In a similar manner, real time parking information enables users to choose a parking place under constantly changing parking conditions.

FIG. 1 shows a block diagram of a system 100 configured to determine availability of vehicle parking, according to an example embodiment of the present invention. As shown in FIG. 1, system 100 includes a sensor system 104, a parking availability determiner 106, and storage 108. System 100 interacts with a parking lot 102 to determine available parking for parking lot 102. Parking lot 102 includes one or more parking space(s) 114, and may include any configuration of parking space(s) 114, including street parking, a parking lot, a parking garage having any number of floors/levels, and/or any other parking configuration. The elements of system 100 shown in FIG. 1 are described as follows.

Sensor system 104 is configured to monitor parking space (s) 114 of parking lot 102. Sensor system 104 may include one or more sensor elements to perform the monitoring, including a sensor array. Sensor system 104 may include one or more of any suitable type of sensor, including an optical sensor (e.g., a light emitter and photodetector, an image capturing device such as a camera, etc.), an acoustic sensor, a proximity sensor, a movement sensor, a weight sensor, a magnetic loop sensor, etc. Examples sensors are described further below. As shown in FIG. 1, sensor system 104 generates a sensor data output signal 110.

Parking availability determiner 106 receives sensor data output signal 110 and generates parking availability information 112. Parking availability determiner 106 is configured to determine from sensor data output signal 110 at least one parking space of parking space(s) 114 that is occupied (if one or more parking spaces are occupied). Parking availability determiner 106 is configured to include an indication in parking availability information 112 of the determined occupied parking spaces, and an indication in parking availability information 112 of determined unoccupied parking spaces, which may be indicated as available for parking. In an embodiment, parking availability determiner 106 may determine from sensor data output signal 110 which of parking space(s) 114 are unoccupied (e.g., by receiving a sensor indication that they are unoccupied). Alternatively, parking availability determiner 106 may assume that further parking spaces of parking lot 102 that are not determined to be occupied are therefore unoccupied, and such further parking spaces may be indicated as available for parking.

In an embodiment, parking availability determiner 106 may generate parking availability information 112 to include a list of all parking space(s) 114 in parking lot 102 (e.g., listing each parking space by associated identification number), and an indication for each parking space whether it is occupied or available. Furthermore, parking availability information 112 may optionally include map data enabling a map of parking lot 102 to be generated, with parking availability overlaid on the map (e.g., indicating physical location information for each of each of parking space(s) 114 in parking lot 102, and indicating each of parking space(s) 114 as occupied or available). Still further, parking availability information 112 may include information such as price information for each of parking space(s) 114 (e.g., cost per hour, parking meter rates, etc.), hours of operation for parking lot 102, identifying information for parking lot 102 (e.g., parking lot name), location information for parking lot 102 (e.g., coordinate information for positioning parking lot 102 on a map, a street address, etc.), and/or further information.

Figure 2:
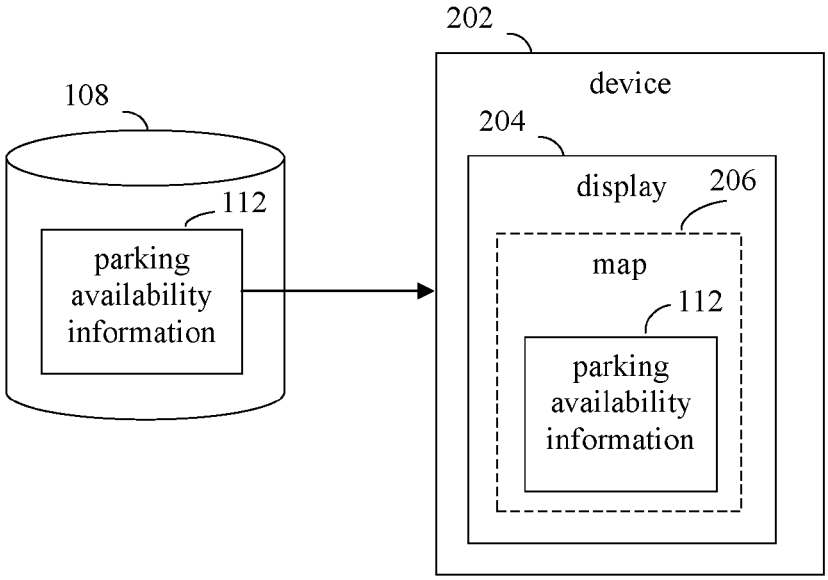
FIG. 2 shows a device that accesses storage to receive parking availability information, according to an example embodiment of the present invention.

As shown in FIG. 2, parking availability information 112 generated by parking availability determiner 106 may be stored (optionally) in storage 108. Storage 108 may include any type of storage mechanism, including a hard disk drive, an optical disc drive, a memory device such as a RAM device, a ROM device, etc., and/or any other suitable type of storage medium.

In an embodiment, users may access parking availability information 112 using electronic devices to assist the users with selecting a parking space. For instance, FIG. 2 shows a device 202 that accesses storage 108 to receive parking availability information 112, according to an example embodiment of the present invention (alternatively, device 202 may directly access parking availability determiner 106 for parking availability information 112). Device 202 may access storage 108 locally or over a network. As shown in FIG. 2, device 202 includes a display 204. Display 204 enables display of parking availability information 112 to a user of device 202. Display 204 of device 202 may display parking availability information 112 to the user in a textual and/or graphical manner. For example, in an embodiment, parking availability information 112 may be displayed by display 204 in a list that includes a listing of parking space identification numbers and availability information for parking lot 102 (e.g., "Joe's Parking Lot"), such as shown below in Table 1:

TABLE 1

| Joe's Parking Lot<br>1st and Main Street, New Francisco, California | |
|---|---|
| Parking Space | Status |
| 1st floor, parking space A101 | Available |
| 1st floor, parking space A102 | Occupied |
| 1st floor, parking space A103 | Available |
| . . . | |
| 2nd floor, parking space B101 | Occupied |
| 2nd floor, parking space B102 | Occupied |
| . . . | |

Thus, a user of device 202 that desires to park in Joe's Parking Lot may refer to a textual display by display 204 of parking space identification numbers and availability information, as shown above in Table 1.

Figure 3:
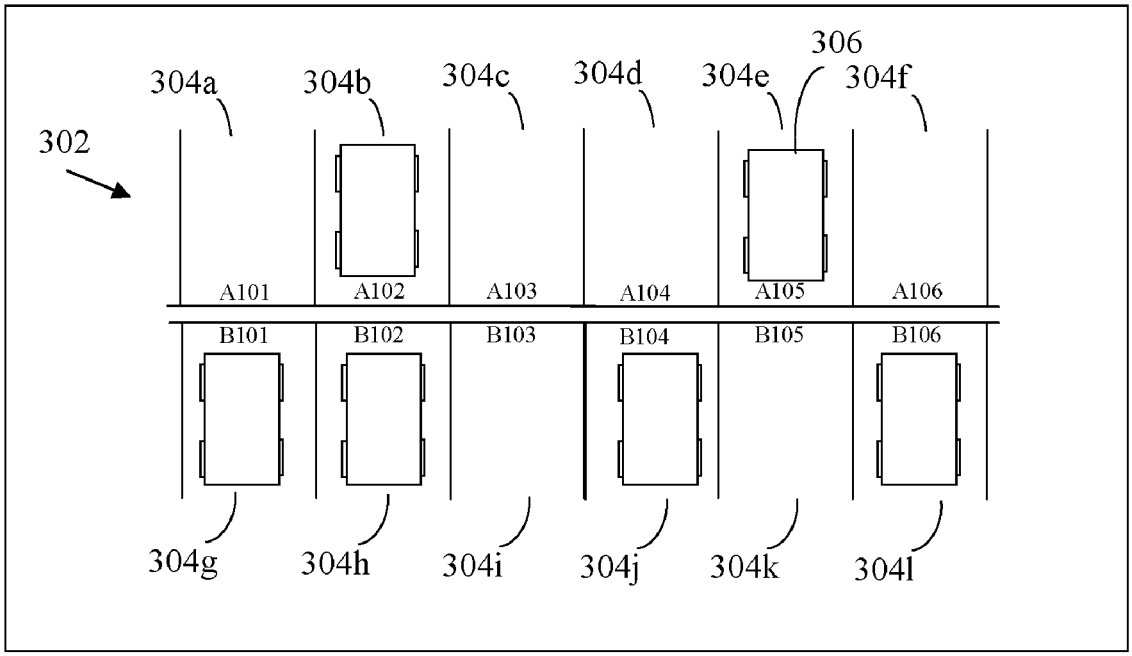
FIG. 3 shows a parking availability image that may be generated from parking availability information and displayed by a device, according to an example embodiment of the present invention.

Alternatively, in an embodiment, parking availability information 112 may be graphically displayed by display 204 in the form of an overhead view or other view of parking lot 102, graphically showing each of parking space(s) 114 as available or occupied. For example, FIG. 3 shows a parking availability image 300 that may be generated from parking availability information 112, and displayed by display 204 of device 202, according to an example embodiment of the present invention. As shown in FIG. 3, parking availability image 300 is an image of a parking lot 302. In the example of FIG. 3, parking lot 302 includes two rows of parking spaces 304, the first row including parking spaces 304*a*-304*f*, and the second row including parking spaces 304*g*-304*l*. Each displayed parking space 304 optionally includes an identification number, which are shown in FIG. 3 as A101-A106 for parking spaces 304*a*-304*f* and B101-B106 for parking spaces 304*g*-304*l*. In the example of FIG. 3, image 300 displays an available parking space 304 as empty, and displays an occupied parking space 304 as including a vehicle icon 306. For instance, in FIG. 3, parking spaces 304*a*, 304*c*, 304*d*, 304*f*, 304*i*, and 304*k* are indicated as available, and parking spaces 304*b*, 304*e*, 304*g*, 304*h*, 304*j*, and 304*l* are indicated as occupied (by including vehicle icon 306). In other embodiments, available and occupied parking spaces 304 may be indicated in alternative ways.

A user of device 202 that desires to park in parking lot 302 may refer to the graphical (which also optionally includes textual information) display by display 204 of image 300, which shows an arrangement of parking spaces 304 and availability information. Note that the arrangement of parking spaces 304*a*-304*l* shown in image 300 may correspond to an actual physical arrangement of parking spaces 304*a*-304*l* in parking lot 302, which may enhance an ability of the user of device 202 to physically locate an available parking space (e.g., parking space 304*c*) while driving through parking lot 302. Alternatively, parking spaces 304*a*-304*l* shown in image 300 may be arranged in a logical/virtual arrangement that does not necessarily match an actual physical arrangement of parking spaces 304*a*-304*l*.

In another embodiment, parking availability information 112 may be graphically displayed by display 204 in a map 206, as shown in FIG. 2. For example, map 206 may be a map of the geographical surroundings of parking lot 102, and may optionally show driving directions to parking lot 102 and/or driving directions to a particular parking space in parking lot 102.

Figure 4:
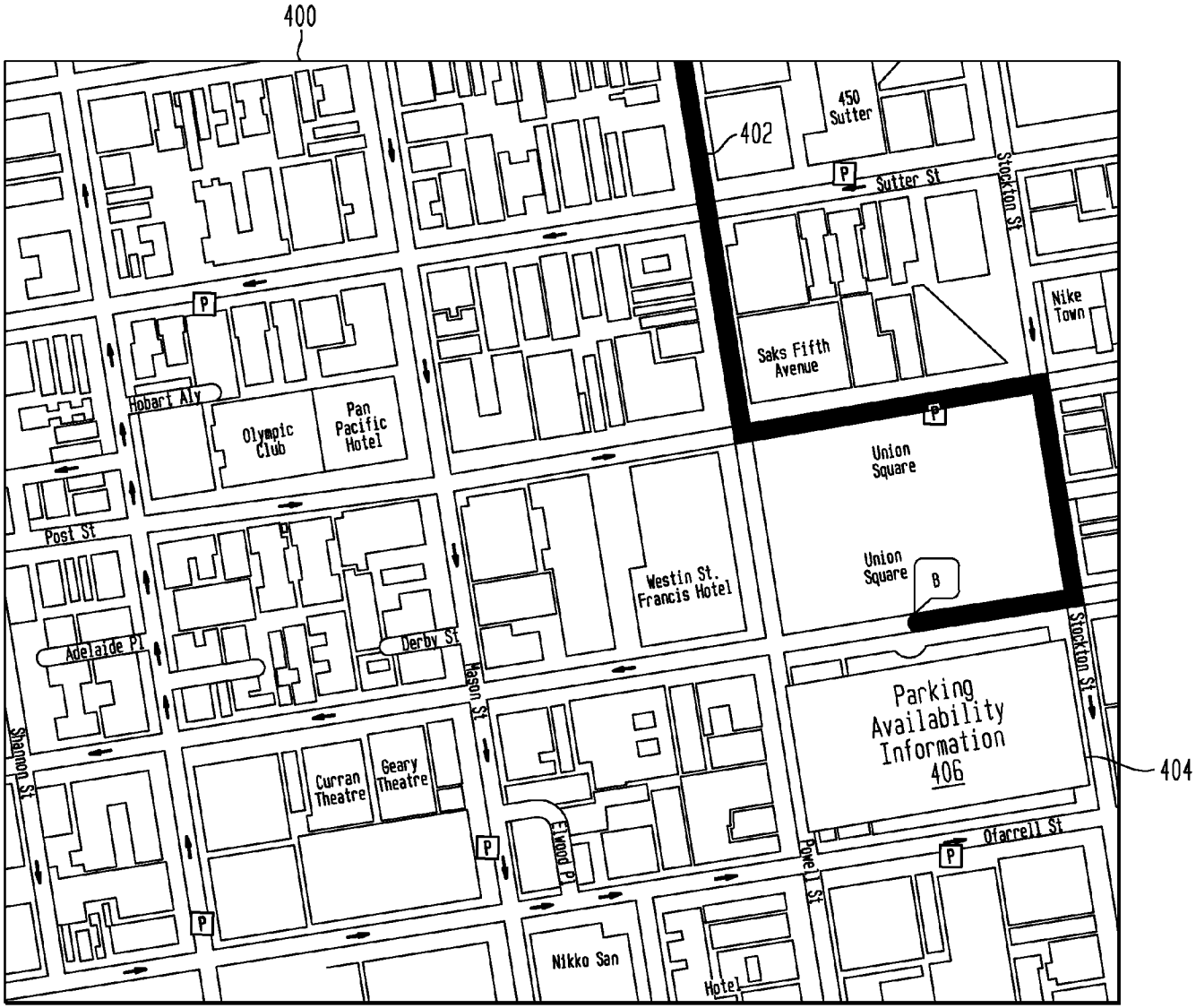
FIG. 4 shows a map or a region that includes a parking lot, according to an example embodiment of the present invention.

For instance, FIG. 4 shows a map 400 as an example of map 206, according to an embodiment of the present invention. Map 400 is a map of a region, showing various geographical and navigational features, including roads and buildings. Map 400 shows a plot of driving directions 402 from a first geographic location (not shown in map 400 due to the degree of zoom) to a parking lot 404, which is an example of parking lot 102 of FIG. 1. In the example of FIG. 4, driving directions 402 are shown as a line that follows selected roads/streets and turns several corners in map 400. As shown in map 400, parking availability information 406 may be displayed in parking lot 404. Parking availability information 406 may include any parking availability information described herein, including information indicating occupied and available parking spaces in parking lot 404. For example, parking availability information 406 displayed in map 400 may be a textual description of parking lot 404 and/or of parking availability in parking lot 404. In another example, parking availability information 406 displayed in map 400 may be a graphical (and optionally textual) description of parking lot 404, such as being an image of parking lot 404 similar to image 300 shown in FIG. 3.

Figure 5:
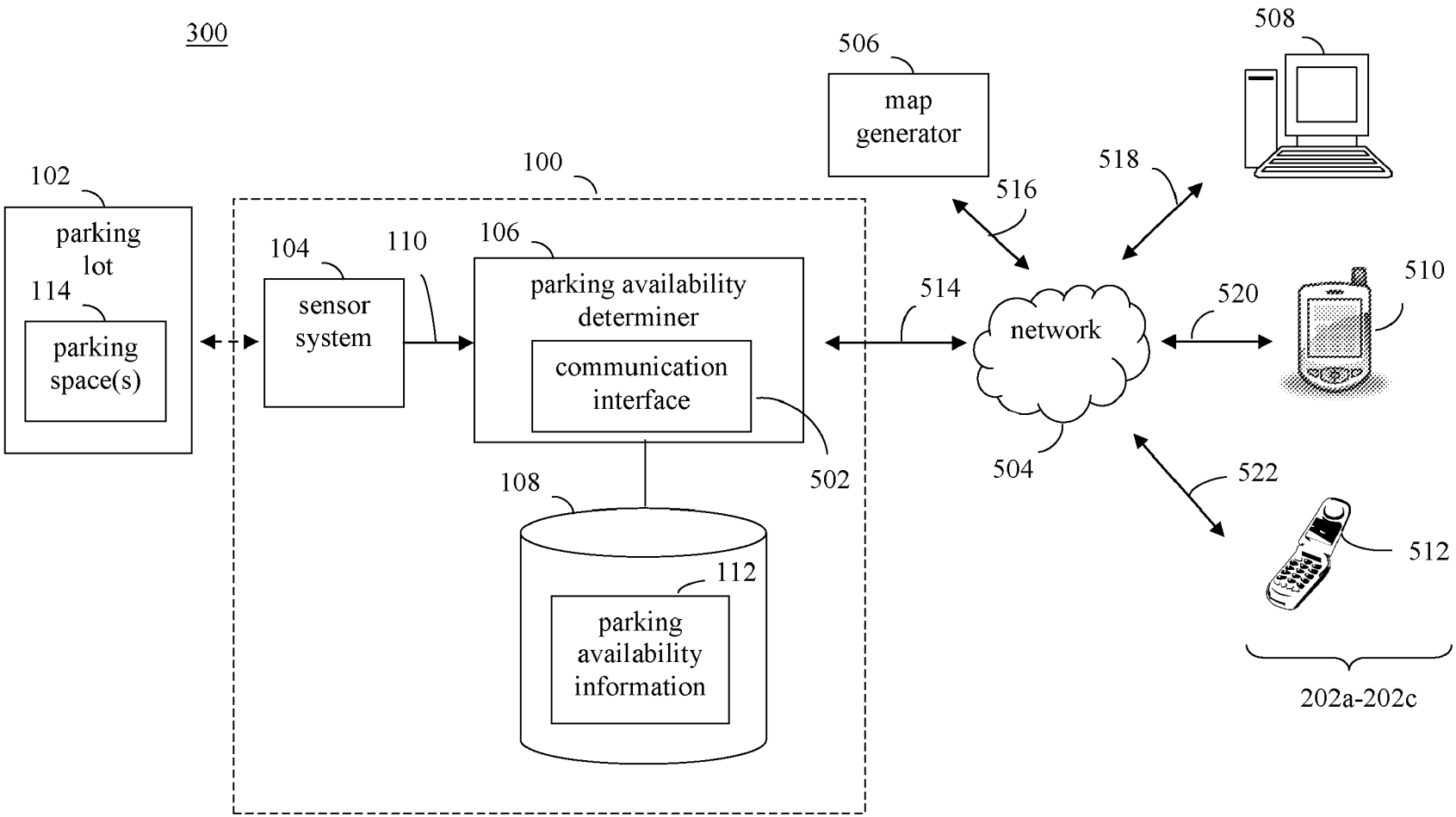
FIG. 5 shows a block diagram of a parking availability communications system, according to an example embodiment of the present invention.

Communications between system 100 of FIG. 1 and device 202 of FIG. 2 may be performed in a variety of ways. For instance, FIG. 5 shows a block diagram of a parking availability communications system 300, according to an example embodiment of the present invention. As shown in FIG. 5, system 300 includes system 100, a network 504, a map generator 506, and devices 202*a*-202*c*. As shown in FIG. 5, system 100 includes sensor system 104, parking availability determiner 106, and storage 108. In the embodiment of FIG. 5, parking availability determiner 106 includes a communication interface 502.

As shown in FIG. 5, parking availability determiner 106 is communicatively coupled with devices 202*a*-202*c* through network 504. Network 504 may be a LAN, a WAN, or combination of networks, such as the Internet. Three example devices are shown as devices 202*a*-202*c* in FIG. 5, for purposes of illustration. Hundreds, thousands, or even millions of devices 202 may be present. Example devices 202*a*-202*c* are, respectively, a desktop computer 508, a mobile computing device 510, and a mobile phone 512. Desktop computer 508 may be any type of stationary computer mentioned herein or otherwise known, including a personal computer. Mobile computing device 510 may be any type of mobile computing device, including a mobile computer (e.g., a Palm® device, a personal digital assistant (PDA), a laptop computer, a notebook computer, etc.) or mobile email device (e.g., a RIM Blackberry® device). Mobile phone 512 may be any type of mobile phone, including a cell phone. Any number and type of devices 202 may be used by users to interact with parking availability determiner 106 to obtain parking availability information 112, including or alternative to the example user devices shown in FIG. 5. Mobile devices such as mobile phone 512 and mobile phone 512 may be particularly useful for obtaining and displaying real time parking information, such as when the user of the mobile device is nearing or has entered parking lot 102.

Each user device may communicate with parking availability determiner 106 through a corresponding communication link. For example, as shown in FIG. 5, desktop computer 508 is communicatively coupled with network 504 through a first communication interface 518, mobile computing device 510 is communicatively coupled with network 504 through a second communication interface 520, and mobile phone 512 is communicatively coupled with network 504 through a third communication interface 522. Parking availability determiner 106 is shown communicatively coupled with network 504 through a fourth communication interface 514. First-fourth communication interfaces 518, 520, 522, and 514 may include any type or combination of communication links, including wired and/or wireless links, such as IEEE 802.11 wireless LAN (WLAN) wireless links, cellular network links, wireless personal area network (PAN) links (e.g., Bluetooth™ links), Ethernet links, USB links, etc. Techniques such as webpage browsing, emailing, text messaging (e.g., SMS—short message service), etc., may be used to provide parking availability information 112 to desktop computer 508, mobile computing device 510, and mobile phone 512 over communication interfaces 518, 520, and 522, respectively.

Communication interface 502 may be configured to enable communications by parking availability determiner 106 over network 504. Communication interface 502 may be any type of communication network interface (e.g., network interface card (NIC)), wired or wireless, such as an as IEEE 802.11 wireless LAN (WLAN) wireless interface, an Ethernet interface, a USB interface, etc.

In an embodiment, map generator 506 may be present in system 300. Map generator 506 is a map generating tool that may be used to generate a map of a region, such as map 206 shown in FIG. 2, including generating driving directions for display on the map (e.g., as shown in map 400 in FIG. 4). Map generator 506 may be one of a number of available interactive Internet-based mapping portals, such as Yahoo!® Maps, MapQuest, and Google™ Maps. According to an embodiment, map generator 506 is configured to generate a map for display on a device 202 that includes parking availability information 112.

For example, in an embodiment, a user may enter a start location (e.g., in the form of an address, a city, a zip code, etc.) and a destination location into an interface (e.g., a web browser) at a device 202. Alternatively, the user may enter just a destination location, or may enter a specific parking lot. Device 202 transmits the entered location information in a communication signal through network 504 to map generator 506 (which may be hosted by one or more servers). Map generator 506 receives and processes the location information to generate map data, which may include mapping information regarding the start and destination locations, information for driving from the start location to the destination location, and/or parking availability information. For example, if a parking lot, such as parking lot 102, is present within the bounds of a map to be generated by map generator 506, map generator 506 may transmit a communication signal through network 504 to parking availability determiner 106 to request parking availability information 112 for the parking lot. Parking availability determiner 106 may generate parking availability information 112 for the parking lot in response to the request, or may access parking availability information 112 in storage 108 that was already generated for the parking lot.

Parking availability determiner 106 transmits the generated/accessed parking availability information 112 in a communication signal through network 504 to map generator 506. Map generator 506 incorporates the received parking availability information 112 into map data generated in response to the request by device 202, and transmits the map data in a communication signal through network 504 to the requesting device 202. Referring to FIG. 2, display 204 of the receiving device 202 displays map 206 based on the received map data. In particular, map 206 shows start and destination locations (if requested), driving directions (if requested), and parking availability information 112. Furthermore, map 206 may be coded to indicate various levels of parking availability indicated by parking availability information 112. For example, map generator 506 may use colors and/or patterns to indicate a level of parking availability for parking lot 404 in map 400 shown in FIG. 4. For instance, parking lot 404 may be colored/tinted green to indicate a relatively high number of available parking spaces, or may be colored/tinted red to indicate a relatively low number of available parking spaces.

Further description of map generators and maps that indicate driving directions and parking lots that are applicable to embodiments of the present invention is provided in co-pending, commonly owned U.S. application Ser. No. 12/029,243, titled "Real Time Parking Search and Point-to-Point Direction Generator," filed Feb. 11, 2008, which is incorporated by reference herein in its entirety.

Example Methods for Determining Parking Availability

Figure 6:
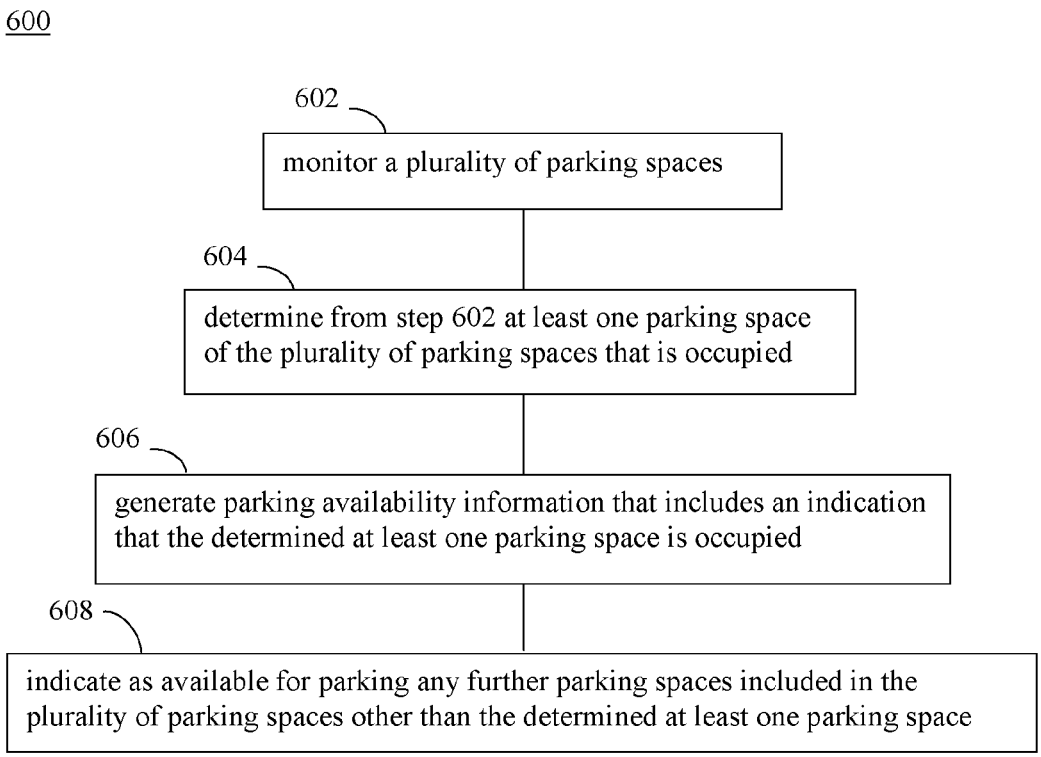
FIG. 6 shows a flowchart for generating parking availability information, according to an example embodiment of the present invention.

System 100 shown in FIG. 1 may be configured to generate parking availability information 112 in various ways, including various methods described throughout this document. For instance, in an embodiment, system 100 may operate according to a method shown in FIG. 6. FIG. 6 shows a flowchart 600 for generating parking availability information, according to an example embodiment of the present invention. Further structural and operational embodiments will be apparent to persons skilled in the relevant art(s) based on the discussion regarding flowchart 600.

Figure 7:
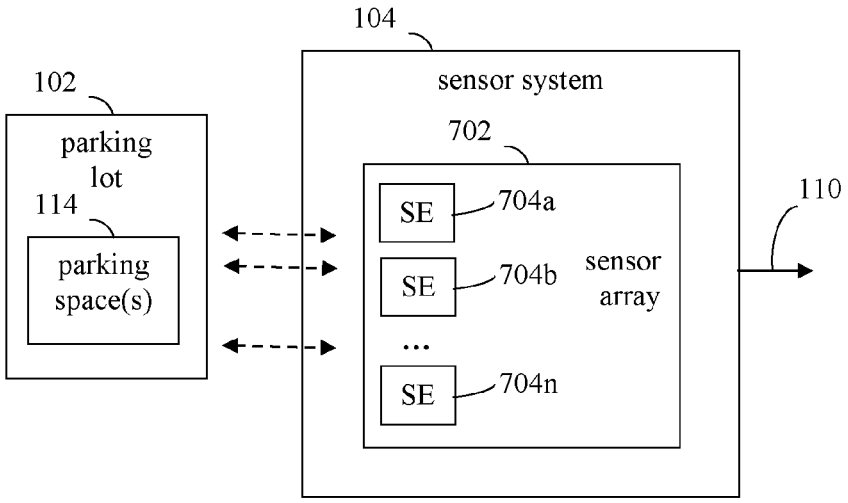
FIG. 7 shows a block diagram of a sensor system, according to an example embodiment of the present invention.

Flowchart 600 begins with step 602. In step 602, a plurality of parking spaces is monitored. For example, in an embodiment, sensor system 104 may monitor parking space(s) 114 of parking lot 102. FIG. 7 shows a block diagram of sensor system 104, according to an example embodiment of the present invention. As shown in FIG. 7, sensor system 104 may include a sensor array 702. For example, sensor array 702 may include a plurality of sensor elements 704*a*-704*n*, with each sensor element 704 associated with one or more parking space, or with multiple sensor elements 704 associated with each parking space. Further detail and examples of sensor system 104 and sensor array 702 are described below.

In step 604, at least one parking space of the plurality of parking spaces that is occupied is determined from step 602. As described above, and shown in FIGS. 1 and 7, sensor system 104 generates a sensor data output signal 110. Sensor data output signal 110 includes sensor data generated by one or more sensor elements 704 of sensor system 104. Parking availability determiner 106 is configured to analyze the sensor data to determine whether parking space(s) 114 of parking lot 102 are occupied. Examples of step 604 are described in detail below for different types of sensor data.

In step 606, parking availability information is generated that includes an indication that the determined at least one parking space is occupied. As described above, parking availability determiner 106 generates parking availability information 112, which includes an indication of which of parking space(s) 114 are occupied.

In step 608, any further parking spaces included in the plurality of parking spaces other than the determined at least one parking space are indicated as available for parking. As described above, in an embodiment, any of parking space(s) 114 that are not determined in step 608 to be occupied may be indicated as unoccupied, and thus may be indicated as available for parking.

Example Sensor Systems for Monitoring Parking Spaces

Example embodiments for sensor system 104 are described in this section. As described above, sensor system 104 may include a single sensor element, or a plurality of sensor elements, such as an array of sensors (e.g., sensor array 702 of FIG. 7). Example single sensor element embodiments and sensor array embodiments are described as follows.

Figure 8:
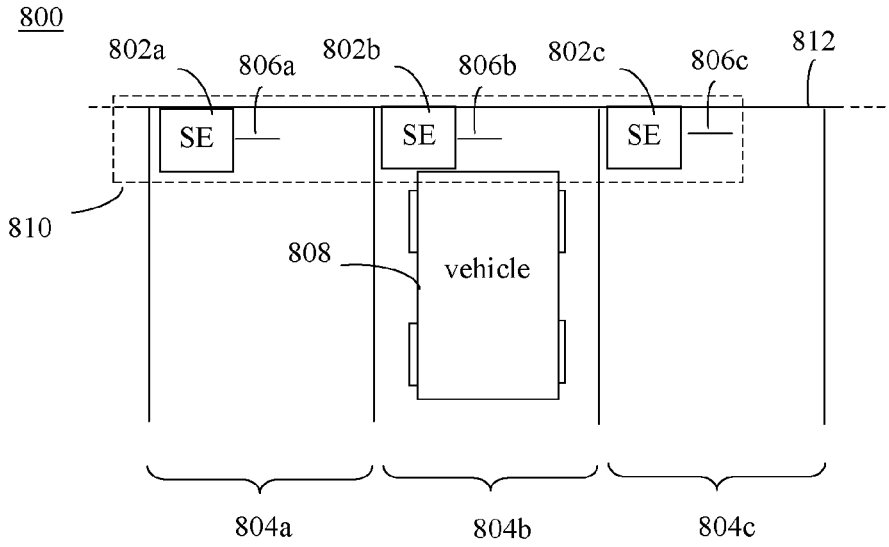
FIGS. 8-12 show examples of a sensor array configured to monitor a parking lot, according to embodiments of the present invention.

For instance, FIG. 8 shows a sensor and parking configuration 800, according to an example embodiment of the present invention. As shown in FIG. 8, configuration 800 includes a sensor array 810 that is configured to monitor a parking lot 812. Sensor array 810 is an example of sensor array 702 of FIG. 7. For ease of illustration, FIG. 8 shows a portion of parking lot 812, including three consecutively arranged parking spaces 804*a*-804*c*. Sensor array 810 includes first-third sensor elements 802*a*-802*c*. In embodiments, sensor array 810 may include any number of sensor elements 802*a*-802*c*, depending on a number of parking spaces 804, and a ratio of sensor elements 802 to parking spaces 804 used for a particular implementation of sensor array 810.

As shown in FIG. 8, each of first-third sensor elements 802*a*-802*c* is positioned to monitor a corresponding one of first-third parking spaces 804*a*-804*c*. Each sensor element 802*a*-802*c* generates a corresponding one of sensor element output signals 806*a*-806*c*, each of which are included in sensor data output signal 110. In embodiments, each sensor element output signal 806 may be transmitted wirelessly and/or by wire from a corresponding sensor element 802. Sensor elements 802 may be configured in various ways to detect whether corresponding parking spaces 804 are occupied or unoccupied. In FIG. 8, sensor elements 802*a*-802*c* respectively generate sensor element output signals 806*a*-806*c*, which are received by parking availability determiner 106 (in sensor data output signal 110). Parking availability determiner 106 analyzes sensor element output signals 806*a*-806*c* to determine whether parking is available in corresponding parking spaces 804*a*-804*c*.

In the example of FIG. 8, parking spaces 804*a* and 804*c* are unoccupied, and parking space 804*b* is occupied by a vehicle 808. As a result, sensor element output signals 806*a* and 806*c* generated by sensor elements 802*a* and 802*c*, respectively, include sensor output information that can be analyzed by parking availability determiner 106 to determine parking spaces 804*a* and 804*c* are unoccupied, and sensor element output signal 806*b* generated by sensor element 802*b* includes sensor output information that can be analyzed by parking availability determiner 106 to determine that parking space 804*b* is occupied.

Figure 9:
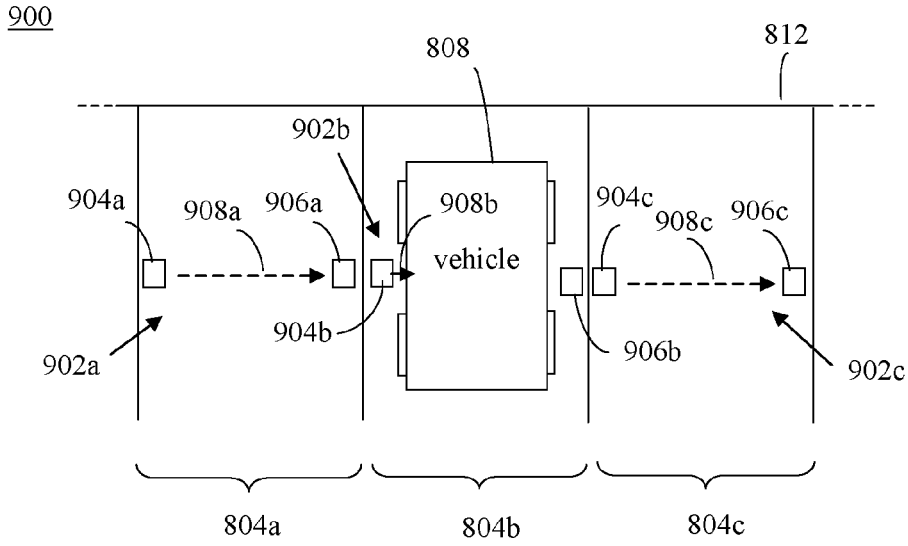

FIGS. 9-12 show various example types of sensors for sensor elements 802*a*-802*c* of FIG. 8. For instance, FIG. 9 shows a sensor and parking configuration 900, according to an example embodiment of the present invention. As shown in FIG. 9, configuration 900 includes sensor elements 902*a*-902*c* that are configured to respectively monitor parking spaces 804*a*-804*c* of parking lot 812. In the example of FIG. 9, sensor elements 902*a*-902*c* are each optical sensors. In embodiments, a variety of types of optical sensors may be included in sensor elements 902*a*-902*c*.

In the example of FIG. 9, sensor elements 902*a*-902*c* are respectively positioned in parking spaces 804*a*-804*c*. Each sensor element 902*a*-902*c* includes a corresponding one of light emitters 904*a*-904*c* and of light detectors 906*a*-906*c*. Each light sensor 904 emits a corresponding light beam 908 directed to the corresponding light detector 906. Each light beam 908 is directed across a corresponding parking space 804 such that if a vehicle enters the corresponding parking space 804, light beam 908 will be blocked from being received by the corresponding light detector 906. An indication of whether light beam 908 is or is not received by the corresponding light detector 906 is provided in a sensor element output signal (sensor element output signal 806 shown in FIG. 8) for each of sensor elements 902*a*-902*c*. Each sensor element output signal is received by parking availability determiner 106 to determine whether a corresponding one of parking spaces 804*a*-804*c* is occupied or available.

In the example of FIG. 9, no vehicle is present in parking space 804*c*. Light beam 908*c* emitted by light emitter 904*c* is not blocked, and is received by light detector 906*c*. Thus, sensor element 902*c* generates a sensor element output signal indicating that light beam 908*c* is received. Parking availability determiner 106 receives the indication from sensor element 902*c*. Parking availability determiner 106 analyzes the light beam received indication to determine that parking space 804*c* is not occupied. In the case of parking space 804*b*, vehicle 808 is blocking light beam 908*b* emitted from light emitter 904*b*, and therefore light detector 906*b* does not receive light beam 908*b*. Thus, sensor element 902*b* generates a sensor element output signal indicating that light beam 908*b* is not received. Parking availability determiner 106 receives the indication from sensor element 902*b*. Parking availability determiner 106 analyzes the indication that light beam 908*b* is not received to determine that parking space 804*b* is occupied.

Figure 10:
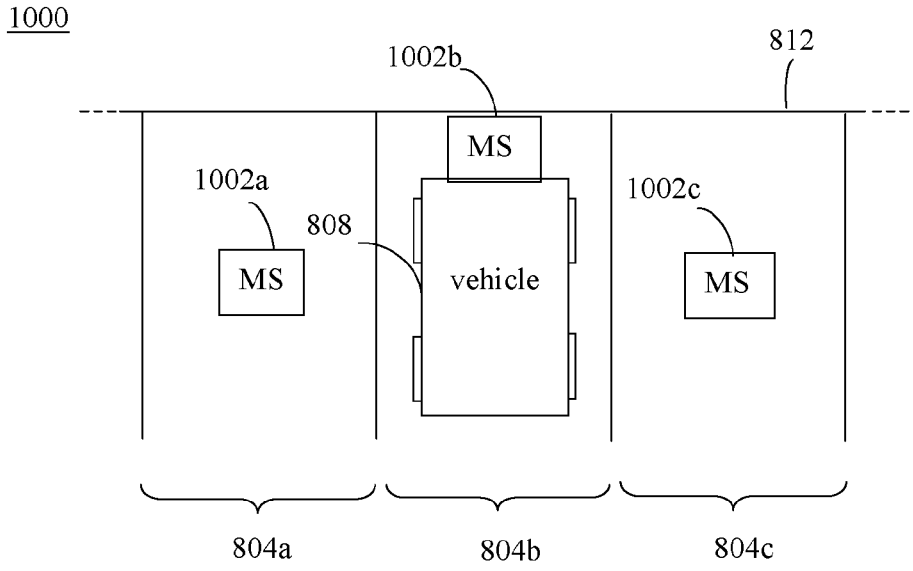

FIG. 10 shows a sensor and parking configuration 1000, according to another example embodiment of the present invention. As shown in FIG. 10, configuration 1000 includes sensor elements 1002*a*-1002*c* that are configured to respectively monitor parking spaces 804*a*-804*c* of parking lot 812. In the example of FIG. 10, sensor elements 1002*a*-1002*c* are each mechanical sensors. In embodiments, a variety of types of mechanical sensors may be included in sensor elements 1002*a*-1002*c*, including contact or touch sensors.

In the example of FIG. 10, sensor elements 1002*a*-1002*c* are respectively positioned in parking spaces 804*a*-804*c*. Each sensor element 1002 is positioned in a respective parking space 804 such that if a vehicle enters the parking space 804, the sensor element 1002 is moved or displaced by the vehicle. For example, a sensor element 1002 may include one or more levers that extend into a parking space 804, an object (e.g., a ball) that dangles/hangs (e.g., by a string, rope, cable, or chain) into a parking space 804, a spring-loaded object that extends from a back end of a parking space 804 towards the center of the parking space 804, or other suitable mechanical sensor configuration. An indication of whether sensor element 1002 is moved/displaced is provided in a sensor element output signal (sensor element output signal 806 shown in FIG. 8) for each of sensor elements 1002*a*-1002*c*. Each sensor element output signal is received by parking availability determiner 106 to determine whether each of parking spaces 804*a*-804*c* is occupied or available.

In the example of FIG. 10, no vehicle is present in parking space 804*c*. Thus, sensor element 1002*c* remains in a non-displaced, centrally located position in parking space 804*c*. Thus, sensor element 1002*c* generates a sensor element output signal indicating that sensor element 1002*c* is not displaced. Parking availability determiner 106 receives the indication from sensor element 1002*c*. Parking availability determiner 106 analyzes the non-displaced indication to determine that parking space 804*c* is not occupied. In the case of parking space 804*b*, vehicle 808 displaces sensor element 1002*b* from a central location in parking space 804*b*. Thus, sensor element 1002*b* generates a sensor element output signal indicating that sensor element 1002*b* is displaced. Parking availability determiner 106 receives the indication from sensor element 1002*b*. Parking availability determiner 106 analyzes the displaced indication to determine that parking space 804*b* is occupied.

Figure 11:
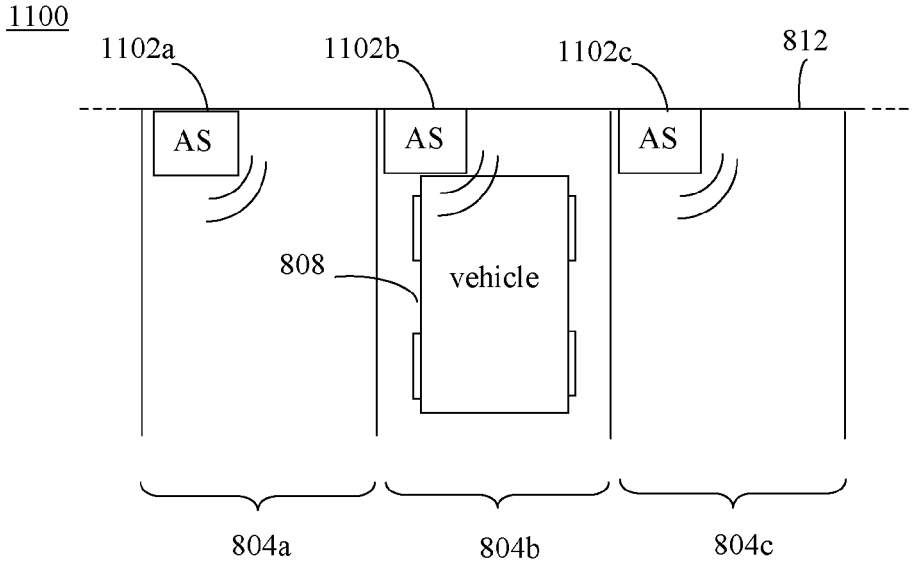

FIG. 11 shows a sensor and parking configuration 1100, according to another example embodiment of the present invention. As shown in FIG. 11, configuration 1100 includes sensor elements 1102*a*-1102*c* that are configured to respectively monitor parking spaces 804*a*-804*c* of parking lot 812. In the example of FIG. 11, sensor elements 1102*a*-1102*c* are each acoustic sensors. In embodiments, a variety of types of acoustic sensors may be included in sensor elements 1102*a*-1102*c*, including an ultrasound-based time-of-flight echo return sensor, a sonar range finder, and further types of acoustic sensors.

In the example of FIG. 11, sensor elements 1102*a*-1102*c* are respectively positioned in parking spaces 804*a*-804*c*, although in an alternative embodiment, they may be positioned adjacent to parking spaces 804*a*-804*c*. Each sensor element 1102 generates an acoustic signal transmitted into the respective parking space 804. If a parking space 804 is empty, little or no reflection of the generated acoustic signal is received back by the sensor element 1102. If a vehicle enters the parking space 804, an increased level of the transmitted acoustic signal is received back by the sensor element 1102, reflected from the vehicle. An indication of whether sensor element 1102 receives a significantly reflected signal is provided in a sensor element output signal (sensor element output signal 806 shown in FIG. 8) for each of sensor elements 1102*a*-1102*c*. Each sensor element output signal is received by parking availability determiner 106 to determine whether each of parking spaces 804*a*-804*c* is occupied or available.

In the example of FIG. 11, no vehicle is present in parking space 804*c*. Thus, sensor element 1102*c* receives little or no reflection of the acoustic signal transmitted by sensor element 1102*c* (e.g., a reflected signal received by sensor element 1102*c* is below a predetermined threshold) parking space 804*c*. Thus, sensor element 1102*c* generates a sensor element output signal indicating that a significant reflection is not received. Parking availability determiner 106 receives the indication from sensor element 1102*c*. Parking availability determiner 106 analyzes the indication that a significant reflection is not received to determine that parking space 804*c* is not occupied. In the case of parking space 804*b*, the proximity of vehicle 808 in parking space 804*b* to sensor element 1102*b* causes a significant reflection of the acoustic signal transmitted by sensor element 1102*b* to be received by sensor element 1102*b*. Thus, sensor element 1102*b* generates a sensor element output signal indicating that a significant reflection is received. Parking availability determiner 106 receives the indication from sensor element 1102*b*. Parking availability determiner 106 analyzes the indication of a significant reflection to determine that parking space 804*b* is occupied.

Figure 12:
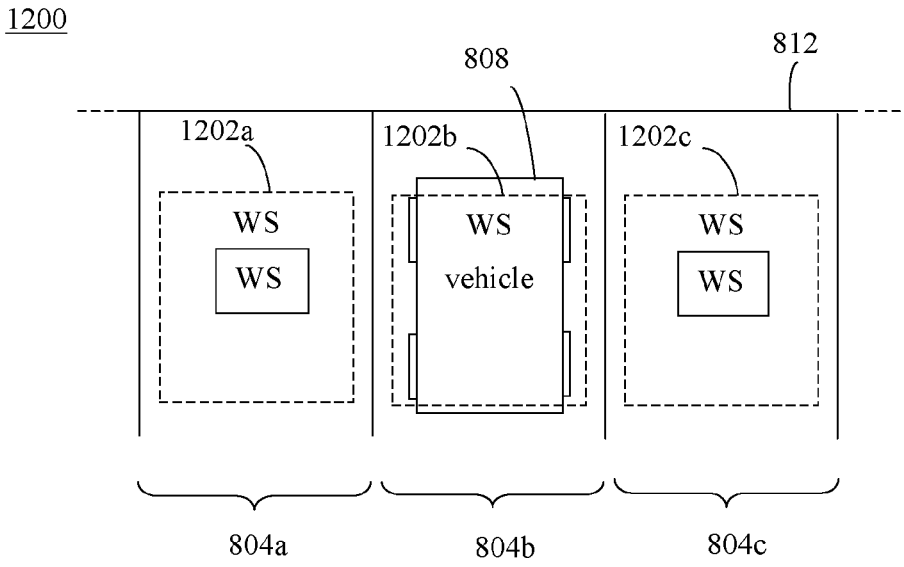

FIG. 12 shows a sensor and parking configuration 1200, according to another example embodiment of the present invention. As shown in FIG. 12, configuration 1200 includes sensor elements 1202*a*-1202*c* that are configured to respectively monitor parking spaces 804*a*-804*c* of parking lot 812. In the example of FIG. 12, sensor elements 1202*a*-1202*c* are each weight sensors. In embodiments, a variety of types of weight sensors may be included in sensor elements 1202*a*-1202*c*, including strain gauges, scales, etc.

In the example of FIG. 12, sensor elements 1202*a*-1202*c* are respectively positioned in parking spaces 804*a*-804*c*. Each sensor element 1202 is positioned in a respective parking space 804 such that if a vehicle enters the parking space 804, the weight of the vehicle causes an output of sensor element 1202 to change. For example, sensor elements 1202 may be located in or on a floor of parking spaces 804. A sensor element 1202 may be configured to determine whether a weight present in a corresponding parking space 804 is over a predetermined threshold weight (which may be a weight of a lightweight motorcycle for motorcycle parking, a weight of a small car for automobile parking, etc.). If the predetermined threshold weight is not exceeded, a vehicle is assumed to not be present in a parking space 804. If the predetermined threshold is exceeded, a vehicle may be assumed to be present in a parking space 804. An indication of whether the predetermined weight is exceeded is provided by sensor element 1202 in a sensor element output signal (sensor element output signal 806 shown in FIG. 8) for each of sensor elements 1202*a*-1202*c*. Each sensor element output signal is received by parking availability determiner 106 to determine whether each of parking spaces 804*a*-804*c* is occupied or available.

In the example of FIG. 12, no vehicle is present in parking space 804*c*. Thus, sensor element 1202*c* measures a weight that is below the pre-determined weight threshold. Sensor element 1202*c* generates a sensor element output signal indicating that the predetermined weight threshold is not exceeded. Parking availability determiner 106 receives the indication from sensor element 1202*c*. Parking availability determiner 106 analyzes the indication that the predetermined weight threshold is not exceeded to determine that parking space 804*c* is not occupied. In the case of parking space 804*b*, vehicle 808 in parking space 804*b* exceeds the predetermined weight threshold. Thus, sensor element 1202*b* generates a sensor element output signal indicating that the predetermined weight threshold is exceeded. Parking availability determiner 106 receives the indication from sensor element 1202*b*. Parking availability determiner 106 analyzes the indication that the predetermined weight threshold is exceeded to determine that parking space 804*b* is occupied.

Figure 13:
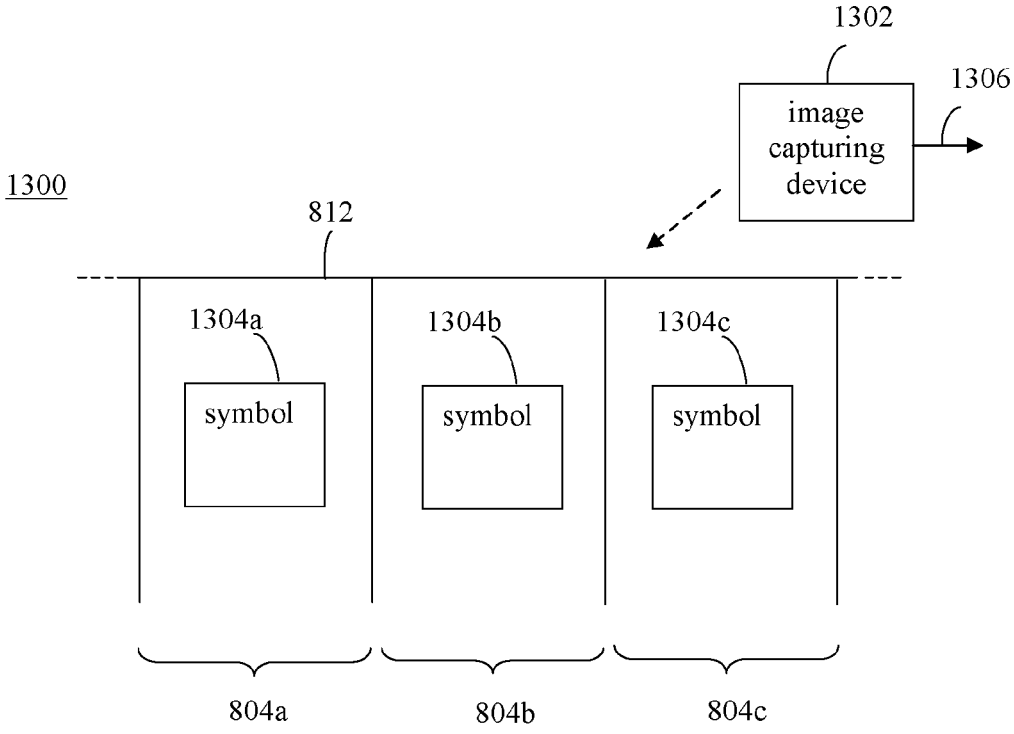
FIG. 13 shows a sensor and parking configuration that includes an image capturing device, according to an example embodiment of the present invention.

As described above, in an embodiment, sensor system 104 of FIG. 1 may include a single sensor element. For instance, FIG. 13 shows a sensor and parking configuration 1300, according to an example embodiment of the present invention. As shown in FIG. 13, configuration 1300 includes an image capturing device 1302. Image capturing device 1302 is configured to monitor parking spaces 804*a*-804*c* of parking lot 812 so that parking availability may be determined. Image capturing device 1302 is an example of sensor system 104.

In embodiments, image capturing device 1302 may include a variety of types of image sensors, including photographic film, a CMOS (complementary metal-oxide-semiconductor) sensor, or a charge coupled device (CCD) sensor. As shown in FIG. 13, image capturing device 1302 generates a captured image signal 1306, which includes one or more captured images of parking lot 812. Captured image signal 1306 is received by parking availability determiner 106 as sensor data output signal 110. Parking availability determiner 106 analyzes sensor data output signal 110 to determine whether each of parking spaces 804*a*-804*c* of parking lot 812 is occupied or available.

As shown in FIG. 13, each of parking spaces 804*a*-804*c* may include a corresponding symbol 1304*a*-1304*c*. Image capturing device 1302 is configured to capture an image of parking lot 812, such that all of symbols 1304*a*-1304*c* may appear in the captured image if not obstructed. The captured image is analyzed by parking availability determiner 106 to determine whether symbols 1304*a*-1304*c* are present in the captured image, and/or are altered from their form in parking spaces 804*a*-804*c* in the captured image. If parking availability determiner 106 determines that one or more symbols 1304*a*-1304*c* are altered and/or not present in the captured image, the corresponding one or more parking spaces 804*a*-804*c* may be indicated as occupied.

Symbols 1304*a*-1304*c* may have a variety of configurations, including being particular geometric shapes, having particular colors, being coded symbols (e.g., 1-dimensional or 2-dimensional barcodes), or other configurations. Symbols 1304*a*-1304*c* may the same symbol, or may each be a uniquely identifiable symbol. Symbols 1304*a*-1304*c* may each have a size approximately equal to the size of a parking space 804, or less than a size of a parking space 804. Examples of symbols 1304 are described further below.

Figure 14:
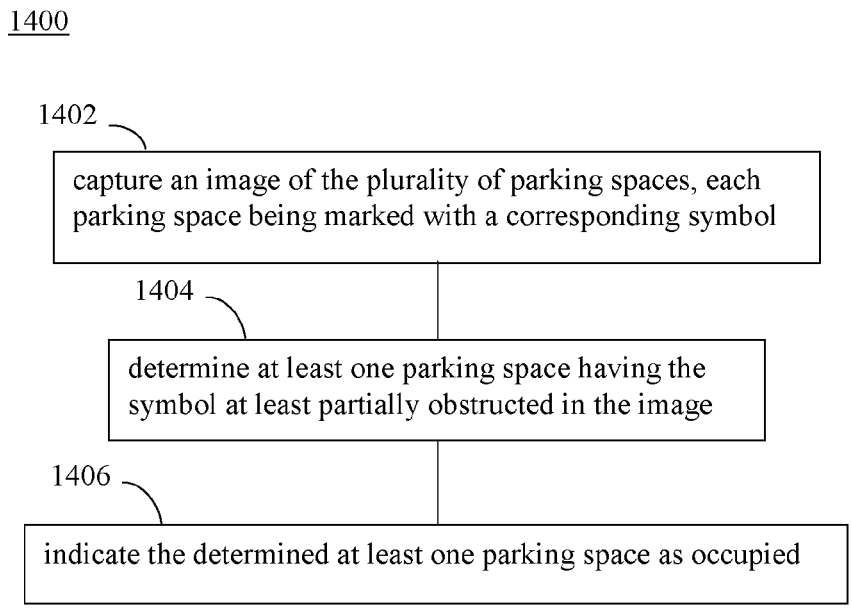
FIG. 14 shows a flowchart for determining parking availability, according to another example embodiment of the present invention.

For instance, FIG. 14 shows a flowchart 1400 for determining parking availability, according to another example embodiment of the present invention. Flowchart 1400 is an example of steps 602-606 of flowchart 600 shown in FIG. 6. Flowchart 1400 may be performed with regard to configuration 1300 shown in FIG. 13. Flowchart 1400 is described with respect to FIG. 13 and FIGS. 15-19, which show various examples of symbols in parking spaces 804*a*-804*c*, according to embodiments. Further structural and operational embodiments will be apparent to persons skilled in the relevant art(s) based on the discussion regarding flowchart 1400.

Flowchart 1400 begins with step 1402. In step 1402, an image of the plurality of parking spaces is captured, each parking space being marked with a corresponding symbol. For instance, as shown in FIG. 13, each of parking spaces 804*a*-804*c* is marked with a corresponding one of symbols 1304*a*-1304*c*. Parking spaces 804*a*-804*c* may be marked with symbols 1304*a*-1304*c* in any manner, including being painted, etched, etc.

Figure 15:
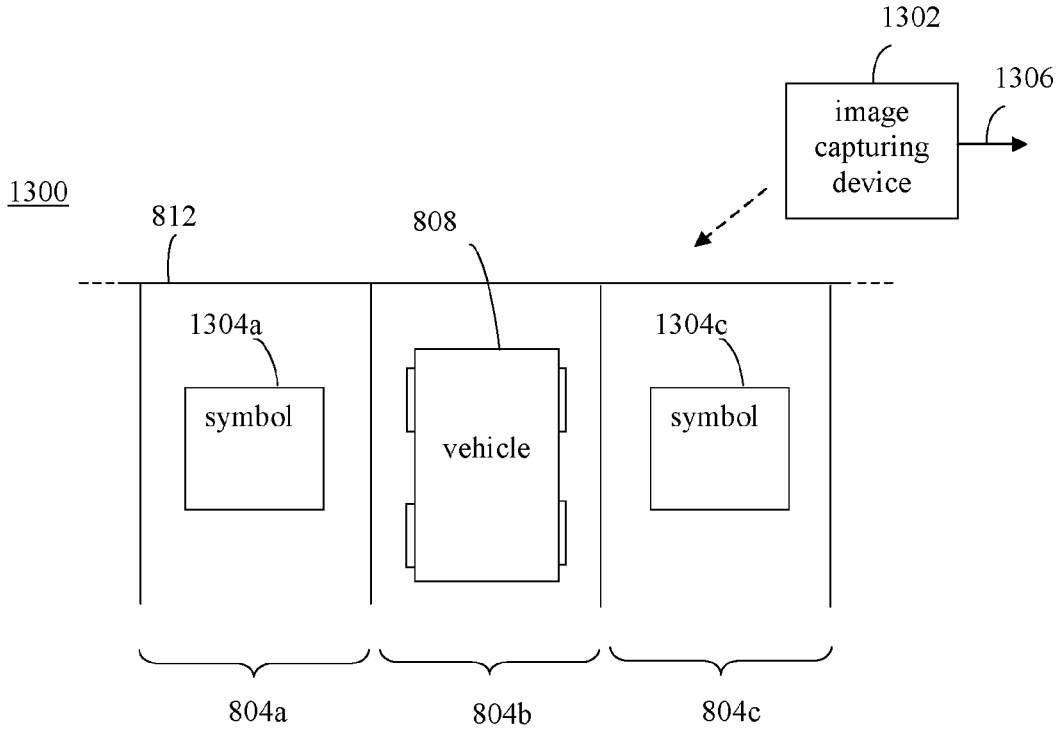
FIGS. 15-19 show examples of symbols that mark parking spaces of a parking lot, according to embodiments of the present invention.

A vehicle may be parked in any one of parking spaces 804*a*-804*c* to occupy the parking space. For instance, in FIG. 15, a vehicle 808 is shown parked in parking space 804*b*, while parking spaces 804*a* and 804*c* remain unoccupied. As shown in FIG. 15, vehicle 808 obstructs symbol 1304*b*, which is located under vehicle 808 in parking space 804*b*. Because parking spaces 804*a* and 804*c* are unoccupied, corresponding symbols 1304*a* and 1304*c* are not obstructed. Image capturing device 1302 may capture an image of parking lot 812 as shown in FIG. 15, and transmit the captured image to parking availability determiner 106 in captured image signal 1306. In the example of FIG. 15, the image captured by image capturing device 1302 shows parking spaces 804*a*-804*c*, with symbol 1304*a* visible in parking space 804*a*, vehicle 808 visible in parking space 804*b* (symbol 1304*b* not being visible due to the presence of vehicle 808), and symbol 1304*c* visible in parking space 804*c*.

In step 1404, at least one parking space having the symbol at least partially obstructed in the image is determined. Parking availability determiner 106 receives captured image signal 1306 as sensor data output signal 110. Parking availability determiner 106 analyzes captured image signal 1306 to determine whether symbols 1304*a*-1304*c* are obstructed. Parking availability determiner 106 may use pattern detection techniques to analyze captured image signal 1306 for symbols, as would be known to persons skilled in the relevant art(s).

In the example of FIG. 15, according to an analysis of captured image signal 1306, parking availability determiner 106 determines that symbols 1304*a* and 1304*c* are present in captured image signal 1306 and that symbol 1304*b* is not present in captured image signal 1306.

In step 1406, the determined at least one parking space is indicated as occupied. Depending on the determination in step 1404 of whether a symbol 1304 is obstructed, parking availability determiner 106 determines whether the corresponding parking space 804 is obstructed. If a symbol 1304 is obstructed in captured image signal 1306, partially or entirely, for a particular parking space 804, the parking space 804 is indicated as occupied. If a symbol 1304 is detected in captured image signal 1306, the corresponding parking space 804 is indicated as unoccupied, and thus available.

In the current example of FIG. 15, because parking availability determiner 106 determines in step 1404 that symbols 1304*a* and 1304*c* are present in captured image signal 1306, parking availability determiner 106 determines that parking spaces 804*a* and 804*c* are unoccupied. Furthermore, because parking availability determiner 106 determines in step 1404 that symbol 1304*b* is not present in captured image signal 1306, parking availability determiner 106 determines that parking space 804*b* is occupied.

As described above, symbols 1304 can have various shapes, including geometric shapes such as a triangle, rectangle, circle, pentagon, or other polygon, or may be irregular in shape. In an embodiment, a shape of symbol 1304 is selected to be a shape that is distinguishable in a captured image from a typical vehicle shape. For example, a rectangle shape may not be desirable for symbol 1304 because a rectangle is similar to a shape of an automobile or truck. A triangle, circle, or pentagon, or other (non-rectangular) polygon may be selected for use as symbol 1304 as being sufficiently different from a shape of a vehicle.

Figure 16:
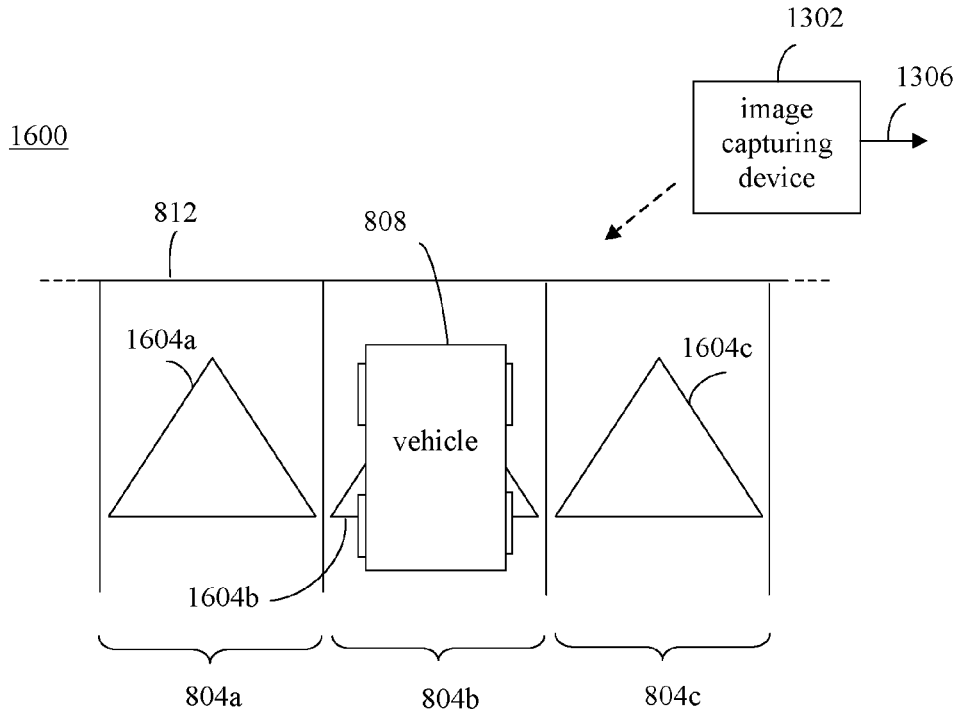

For example, FIG. 16 shows an example sensor and parking configuration 1600, according to an example embodiment of the present invention. As shown in FIG. 16, configuration 1600 is generally similar to configuration 1300 shown in FIG. 13, with symbols 1304*a*-1304*c* being triangle symbols 1604*a*-1604*c*. As shown in FIG. 13, triangle symbols 1604 have widths approximately equal to a width of a parking space 804. Triangle symbols 1604*a* and 1604*c* are visibly distinguishable from a shape of vehicle 808. Thus, the presence of triangles 1604*a* and 1604*c* in captured image signal 1306 may be readily ascertained by parking availability determiner 106 to determine that parking spaces 804*a* and 804*c* are not occupied. Triangle 1604*b* is at least partially obstructed in FIG. 16. Although triangle symbol 1604*b* is partially visible in the captured image, the obstruction of triangle symbol 1604*b* in captured image signal 1306 may be readily ascertained by parking availability determiner 106 due to the change in shape of triangle symbol 1604*b* (e.g., only lower corners of triangle symbol 1604*b* being visible) and/or the combination of vehicle 808 and triangle symbol 1604*b* being a distortion to triangle symbol 1604*b* in captured image signal 1306.

Note that in embodiments, a color of symbols 1304 may be selected to be a color that is typically distinguishable from a color of a vehicle (e.g., a light purple, orange, etc.). If the selected color is present in a parking space 804 in a captured image, parking availability determiner 106 may be configured to determine (from analysis of captured image signal 1306) that the parking space 804 is not occupied. If the color is not present in a parking space 804 in a captured image, or is present over a lesser area of the captured image than for an unobstructed symbol 1304, parking availability determiner 106 may be configured to determine (from analysis of captured image signal 1306) that the parking space 804 is occupied.

Figure 17:
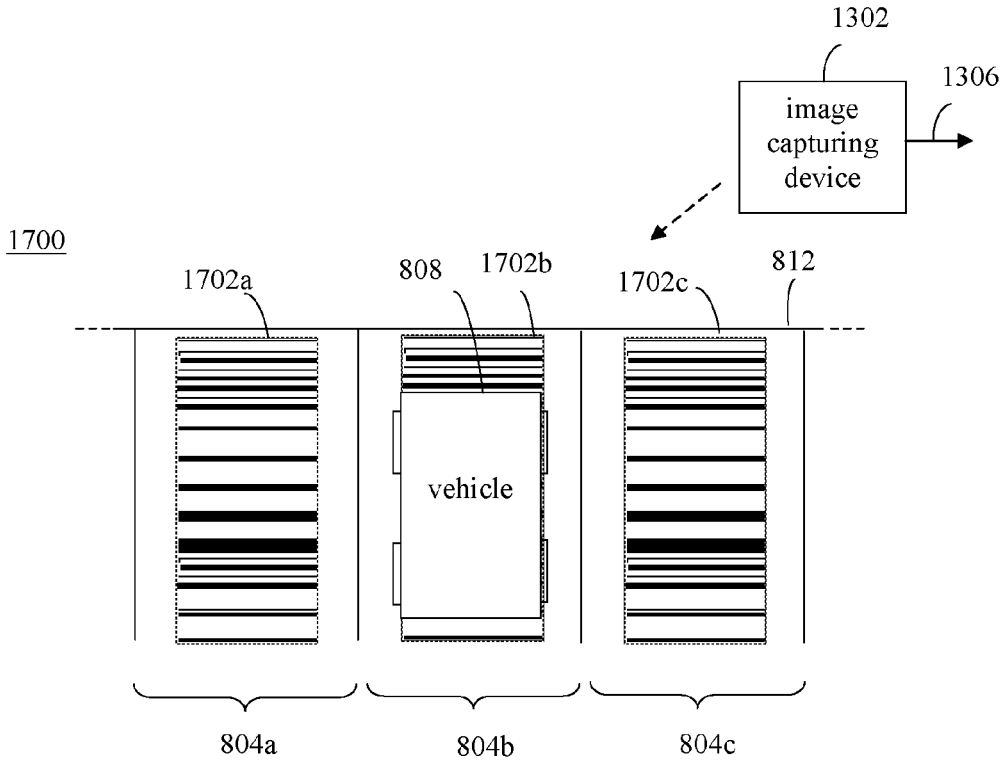

As described above, symbols 1304*a*-1304*c* can be coded. For example, symbols 1304*a*-1304*c* may each be coded in a different manner so that each parking space 804*a*-804*c* may be uniquely identified. For instance, FIG. 17 shows an example sensor and parking configuration 1700, according to an example embodiment of the present invention. As shown in FIG. 17, configuration 1700 is generally similar to configuration 1300 shown in FIG. 13, with symbols 1304*a*-1304*c* being coded symbols 1702*a*-1702*c*. Coded symbols 1702*a*-1702*c* may be any type of coded symbols, including barcodes as shown in FIG. 17. Each of coded symbols 1702*a*-1702*c* may include a unique code or the same code. In the example of FIG. 17, coded symbols 1702 each have a length that is approximately a length of a parking space 804, and a width that is less than or equal to a width of an average sized vehicle.

Parking availability determiner 106 may be configured to determine parking availability (from analysis of captured image signal 1306) for parking lot 812 based on coded symbols 1702 in various ways. For example, as described above, parking availability determiner 106 may determine parking spaces 804*a*-804*c* that are occupied because the corresponding coded symbol 1702 is obstructed in the captured image. For example, using this technique, parking availability determiner 106 may determine that parking space 804*b* is occupied, because coded symbol 1702*b* is obstructed. According to this technique, coded symbols 1702 may or may not necessarily be uniquely identifying.

In another embodiment, parking availability determiner 106 may not be configured to distinguish parking spaces 804 by visible location. In such a situation, uniquely identifying coded symbols 1702 may be used. Parking availability determiner 106 may be configured to determine (from analysis of captured image signal 1306) parking availability by reading all non-obstructed coded symbols 1702 in a captured image of parking lot 812, subtracting the read non-obstructed coded symbols 1702 from a list of all coded symbols 1702, leaving a list of coded symbols 1702 which could not be read in the captured image. The list of coded symbols 1702 which could not be read may be considered a list of coded symbols 1702 for parking spaces 804 that are occupied. The list of coded symbols 1702 for occupied parking spaces 804 may be applied to a location map, which maps the unique values of the coded symbols 1702 to physical locations of the occupied parking spaces 804. In this manner, the locations of the occupied parking spaces 804 can be determined using the unique codes.

Symbols 1304 may be located anywhere in parking spaces 804. For example, as shown in FIGS. 13, 15, and 16, symbols 1304 may be centrally located in parking spaces 804. In this manner, a vehicle may obstruct a symbol 1304 in a parking space 804 in order for occupancy of the parking space 804 to be determined, as long as the vehicle is larger in size than the symbol 1304. Symbols 1304 can be configured to be smaller than an average sized vehicle or than a smallest applicable vehicle. In other embodiments, symbols 1304 may be located elsewhere in parking spaces 804. For example, each parking space 804 may be marked with symbol 1304 at an entrance.

Figure 18:
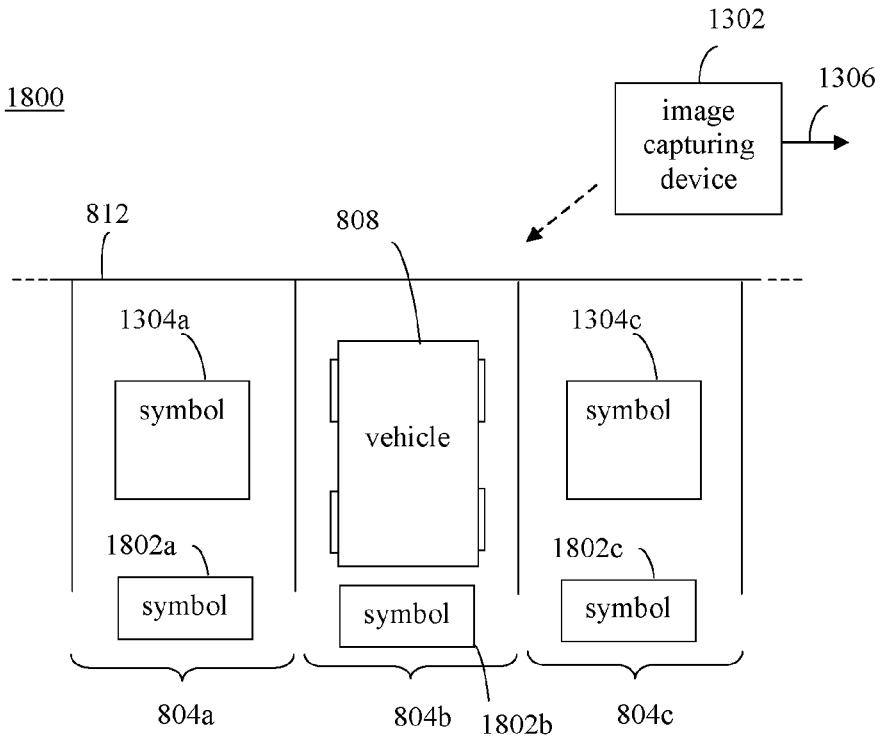
Figure 19:
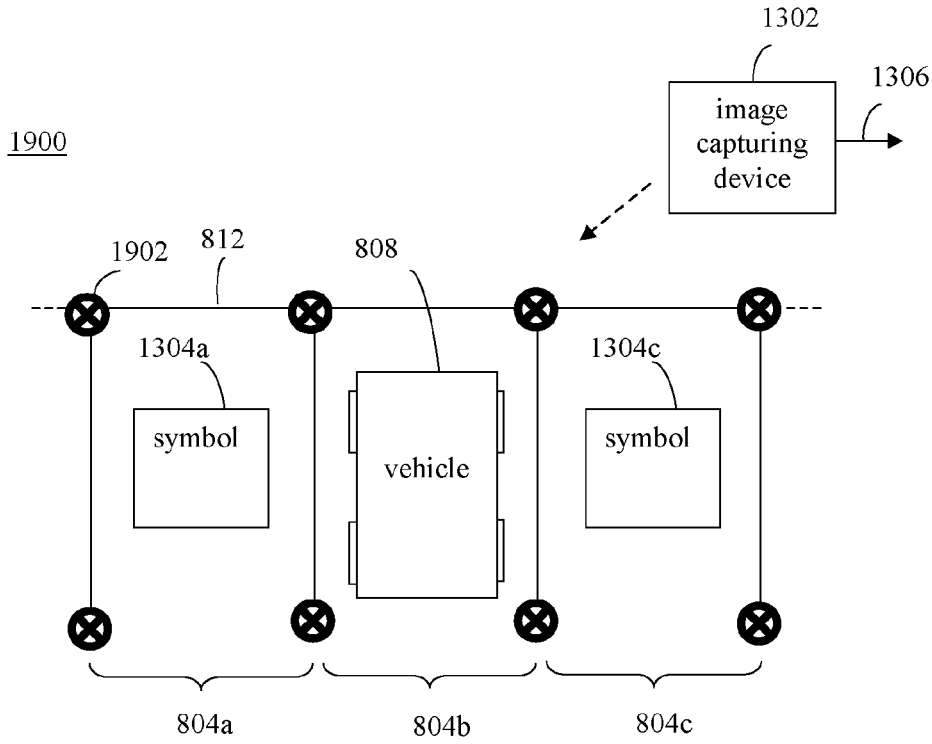

In another embodiment, parking spaces 804 may each be marked with multiple symbols. For instance, FIG. 18 shows an example sensor and parking configuration 1800, according to an example embodiment of the present invention. As shown in FIG. 18, configuration 1800 is generally similar to configuration 1300 shown in FIG. 13, with each of parking spaces 804*a*-804*c* including a corresponding one of first symbols 1304*a*-1304*c* and a corresponding one of second symbols 1802*a*-1802*c*. Second symbols 1802*a*-1802*c* may be positioned in or adjacent to corresponding parking spaces 804*a*-804*c*. For example, as shown in FIG. 19, second symbols 1802*a*-1802*c* may be located adjacent to corresponding parking spaces 804*a*-804*c*, where each of second symbols 1802*a*-1802*c* is located at an entrance of a corresponding one of parking spaces 804*a*-804*c*.

In an embodiment, second symbols 1802*a*-1802*c* may be the same symbol or may be uniquely identifying. For example, in an embodiment, first symbols 1304*a*-1304*c* in parking spaces 804*a*-804*c* may be common symbols used to determine whether parking spaces 804*a*-804*c* are occupied as described above, and second symbols 1802*a*-1802*c* may be uniquely identifying symbols captured in the image, and used by parking availability determiner 106 to uniquely identify each of parking spaces 804*a*-804*c* in an captured image.

In another embodiment, second symbols may be present that enable a location of an associated parking space 804 to be determined by parking availability determiner 106 in an image. For instance, FIG. 19 shows an example sensor and parking configuration 1900, according to an example embodiment of the present invention. As shown in FIG. 19, configuration 1900 is generally similar to configuration 1300 shown in FIG. 13, with each of parking spaces 804*a*-804*c* including a corresponding one of first symbols 1304*a*-1304*c* and a plurality of second symbols 1902. In the example of FIG. 19, second symbols 1902 are located at each corner of each parking space 804. Second symbols 1902 are positioned to delineate a boundary of each parking space 804, so that parking availability determiner 106 can determine a position and/or a size of each parking space 804 by analyzing a captured image, and/or so that parking availability determiner 106 can ascertain where in a captured image that symbols 1304 and/or other parking space features may be located.

In embodiments, any number and position of second symbols 1902 may be used with respect to each parking space 804 to indicate parking space size and/or position. Furthermore, second symbols 1902 may each have any symbol shape and size described herein. For instance, in the example of FIG. 19, second symbols 1902 have a shape of an encircled "x". Second symbols 1902 can have other shapes, such as a "bull's-eye" shape, or other suitable shape described elsewhere herein or otherwise known.

Example Hardware and Software Implementations

Note that parking availability determiner 106 (FIGS. 1 and 5) and/or map generator 506 (FIG. 5) may include hardware, software, firmware, or any combination thereof to perform at least a portion of their functions. For example, parking availability determiner 106 and/or map generator 506 may include computer code configured to be executed in one or more processors. Alternatively, parking availability determiner 106 and/or map generator 506 may include hardware logic/electrical circuitry.

In an embodiment, parking availability determiner 106 and/or map generator 506 may be partially or entirely implemented in one or more computers, including a personal computer, a mobile computer (e.g., a laptop computer, a notebook computer, a handheld computer such as a personal digital assistant (PDA) or a Palm™ device, etc.), or a workstation. These example devices are provided herein purposes of illustration, and are not intended to be limiting. Embodiments of the present invention may be implemented in further types of devices, as would be known to persons skilled in the relevant art(s).

Devices in which embodiments may be implemented may include storage, such as storage drives, memory devices, and further types of computer-readable media. Examples of such computer-readable media include a hard disk, a removable magnetic disk, a removable optical disk, flash memory cards, digital video disks, random access memories (RAMs), read only memories (ROM), and the like. As used herein, the terms "computer program medium" and "computer-readable medium" are used to generally refer to the hard disk associated with a hard disk drive, a removable magnetic disk, a removable optical disk (e.g., CDROMs, DVDs, etc.), zip disks, tapes, magnetic storage devices, MEMS (micro-electromechanical systems) storage, nanotechnology-based storage devices, as well as other media such as flash memory cards, digital video discs, RAM devices, ROM devices, and the like. Such computer-readable media may store program modules that include logic for implementing parking availability determiner 106 and/or map generator 506, flowchart 600 (FIG. 6), flowchart 1400 (FIG. 14), and/or further embodiments of the present invention described herein. Embodiments of the invention are directed to computer program products comprising such logic (e.g., in the form of software) stored on any computer useable medium. Such software, when executed in one or more data processing devices, causes a device to operate as described herein.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A system for determining availability of vehicle parking, comprising:

a sensor system configured to monitor a plurality of parking spaces, the sensor system including at least one sensor element that generates a sensor data output signal; and a parking availability determiner that receives the sensor data output signal and generates parking availability information;

wherein the parking availability determiner is configured to determine from the received sensor data output signal at least one parking space of the plurality of parking spaces that is occupied, to include an indication in the parking availability information that the determined at least one parking space is occupied, and if at least one further parking space is included in the plurality of parking spaces other than the determined at least one parking space, to include an indication in the parking availability information that the at least one further parking space is available for parking;

wherein each parking space of the plurality of parking spaces is marked with a corresponding symbol;

wherein the at least one sensor element includes an image capturing device configured to capture an image of the plurality of parking spaces, and to generate image data corresponding to the captured image, the image data being included in the sensor data output signal; and wherein the parking availability determiner is configured to analyze the image data to detect each parking space having the corresponding symbol at least partially obstructed in the captured image, and to include an indication in the parking availability information that each parking space having an at least partially obstructed corresponding symbol is occupied.

2. The system of claim 1, wherein each parking space is centrally marked with the corresponding symbol.

3. The system of claim 1, wherein each parking space is marked with the corresponding symbol at an entrance.

4. The system of claim 1, wherein each symbol has a size approximately equal to a size of the corresponding parking space.

5. The system of claim 1, wherein each symbol has a size that is less than a size of an average sized automobile.

6. The system of claim 1, wherein each parking space is adjacently marked with a corresponding uniquely identifying second symbol, wherein the parking availability determiner is configured to analyze the image data to detect the corresponding uniquely identifying second symbol for each parking space in the captured image, and to determine an identification number for each parking space from the detected corresponding uniquely identifying second symbol.

7. The system of claim 1, wherein the parking availability determiner is configured to determine a location of a parking space by analyzing the image data to detect at least one second symbol proximate to the parking space in the captured image.

8. The system of claim 1, further comprising:

a communication interface configured to transmit the parking availability information over a network to a device configured to display the parking availability information.

9. A method for determining availability of vehicle parking, comprising:

capturing an image, by an image capturing device, of a plurality of parking spaces, each parking space being marked with a corresponding symbol;

determining, by a parking availability determiner, at least one parking space having the symbol at least partially obstructed in the image;

storing, by a storage medium, an indication that the determined at least one parking space is occupied; and if at least one further parking space is included in the plurality of parking spaces other than the determined at least one parking space, storing, in said storage medium, an indication that the at least one further parking space is available.

10. The method of claim 9, wherein the symbol is a barcode unique to each parking space, wherein said determining comprises:

determining that the barcode marking a parking space is at least partially obstructed in the image if the barcode is not readable in the image.

11. The method of claim 9, wherein said determining comprises:

determining that a first symbol marking a first parking space is at least partially obstructed in the image if the first symbol in the image is at least one of a different shape or a different size from a non-obstructed second symbol marking a second parking space in the image.

12. The method of claim 9, wherein said determining comprises:

determining that a symbol marking a parking space is at least partially obstructed in the image if a color of the symbol in the image cannot be detected.

13. The method of claim 9, wherein each parking space is adjacently marked with a corresponding uniquely identifying second symbol, said method further comprising:

determining an identification number for each parking space according to the corresponding uniquely identifying second symbol in the image.

14. The method of claim 9, further comprising:

determining a location of a parking space in the image by at least detecting a second symbol proximate to the parking space in the image.

15. The method of claim 14, wherein said determining a location of a parking space in the image by at least detecting a second symbol proximate to the parking space in the image comprises:

determining the location of the parking space in the image by detecting a second symbol positioned at each corner of the parking space in the image.

16. The method of claim 9, further comprising:

generating parking availability information that includes the indication that the determined at least one parking space is occupied and the indication that the at least one further parking space is available; and transmitting the parking availability information over a network to a device.

* * * * *